US007137839B2

(12) United States Patent
Dilliner et al.

(10) Patent No.: US 7,137,839 B2
(45) Date of Patent: Nov. 21, 2006

(54) ELECTRICAL CONNECTOR

(75) Inventors: Jennifer L. Dilliner, Peoria, IL (US); Thomas M. Baker, Peoria, IL (US); Sivaprasad Akasam, Peoria, IL (US); Brian D. Hoff, East Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/740,454

(22) Filed: Dec. 22, 2003

(65) Prior Publication Data

US 2005/0136723 A1 Jun. 23, 2005

(51) Int. Cl.
*H01R 13/62* (2006.01)

(52) U.S. Cl. ..... 439/315; 439/320; 439/489

(58) Field of Classification Search ..... 439/133, 439/315, 316, 318, 320, 321, 489, 488; 324/538, 324/72.5; 200/51 R
See application file for complete search history.

(56) References Cited

U.S. PATENT DOCUMENTS 2,710,384 A * 6/1955 Dupre et al. ..... 439/155
4,053,724 A * 10/1977 Llona ..... 200/51 R
4,059,324 A * 11/1977 Snyder et al. ..... 439/321
4,123,629 A * 10/1978 Chagnon et al. ..... 200/51 R
4,289,368 A 9/1981 Schildkraut
4,900,260 A * 2/1990 Drogo ..... 439/321
5,066,919 A * 11/1991 Klassen et al. ..... 324/538
5,438,617 A * 8/1995 Hill et al. ..... 379/327
6,338,657 B1 * 1/2002 Harper et al. ..... 439/692
6,811,423 B1 * 11/2004 Yoshigi et al. ..... 439/315

* cited by examiner

*Primary Examiner*—Alexander Gilman
(74) *Attorney, Agent, or Firm*—Finnegan,Henderson, Farabow,Garrett&Dunner

(57) ABSTRACT

An electrical connector includes a female component having one or more receptacles, a first test receptacle, and a second test receptacle. The electrical connector also includes a male component having one or more terminals configured to engage the one or more receptacles, a first test pin configured to engage the first test receptacle, and a second test pin configured to engage the second test receptacle. The first test receptacle is electrically connected to the second test receptacle, and at least one of the first test pin and the second test pin is shorter in length than the one or more terminals.

28 Claims, 3 Drawing Sheets

ELECTRICAL CONNECTOR

U.S. GOVERNMENT RIGHTS

This invention was made with government support under the terms of Contract No. DE-FC04-2000AL67017 awarded by the Department of Energy. The government may have certain rights in this invention.

TECHNICAL FIELD

This invention relates generally to an electrical connector and, more particularly, to an electrical connector that enables determination of the engagement of two components thereof.

BACKGROUND

Nearly every electrical system has one or more electrical connectors that enable the establishment of electrical connections between various portions of the system. These electrical connectors may include male and female components that, when connected, may be configured to pass various types of electrical signals, including DC voltage potentials and AC voltage signals. In certain embodiments, it may be desirable to know whether the male and female components of the electrical connector are engaged (e.g., connected such that at least one electrically conductive path is established between the male and female components).

Determining whether an electrical connector is properly engaged, however, can be difficult. For example, many electrical connectors may include a housing, locking mechanisms, and other structures that may shield the electrical conductors of the connector from view. Thus, a visual inspection of the outside of an electrical connector may not be determinative of whether the male and female components are properly and/or fully engaged.

At least one electrical connector has been proposed that enables, through visual inspection, a determination of whether the male and female components of the connector are fully engaged. Specifically, U.S. Pat. No. 4,289,368 ("the '368 patent") issued to Schildkraut discloses an electrical connector having a full mate indicator. This indicator may take the form of a button that extends outward from the connector when the male and female components are fully mated.

While the electrical connector of the '368 patent may include an indicator for determining whether the connector components are fully engaged, the connector of the '368 is problematic. For example, the mating condition of the electrical connector may only be determined through visual inspection. Thus, unless the connector is readily viewable during operation, the mating condition of the connector cannot be ascertained. Further, the connector of the '368 patent provides no way, other than through visual inspection, to actively monitor its connectivity during operation. Thus, monitoring the connection condition of the electrical connector of the '368 patent may be difficult or impossible if the connector is embedded within an electrical system or otherwise hidden from view.

The present invention is directed to overcoming one or more of the problems or disadvantages existing in the electrical connectors of the prior art.

SUMMARY OF THE INVENTION

One aspect of the invention includes an electrical connector that includes a female component having one or more receptacles, a first test receptacle, and a second test receptacle. The electrical connector also includes a male component having one or more terminals configured to engage the one or more receptacles, a first test pin configured to engage the first test receptacle, and a second test pin configured to engage the second test receptacle. The first test receptacle is electrically connected to the second test receptacle, and at least one of the first test pin and the second test pin is shorter in length than the one or more terminals.

A second aspect of the invention includes a method of determining whether components of an electrical connector are engaged. The method includes mating a male component of the electrical connector to a female component of the electrical connector. The male component has one or more terminals configured to engage corresponding receptacles on the female component. The male component also has a first test pin and a second test pin configured to engage corresponding first and second test receptacles on the female component. At least one of the first and second test pins is shorter in length than at least one of the one or more terminals. An electrical condition associated with the first and second test pins may be measured, and, based on the measured electrical condition, a determination may be made of whether the male component is engaged with the female component by at least a threshold amount.

DETAILED DESCRIPTION

Figure 1:
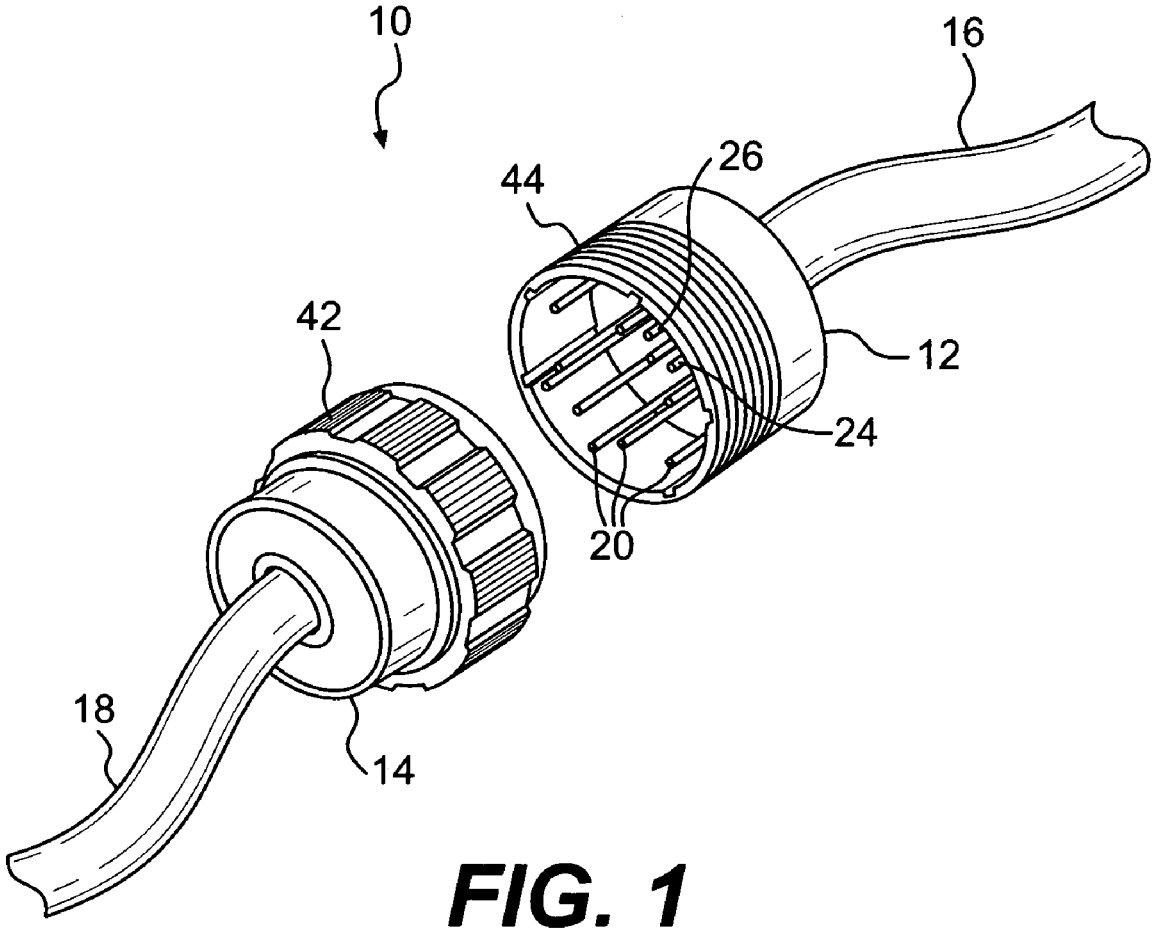
FIG. 1 is a diagrammatic perspective view of an electrical connector in accordance with an exemplary embodiment of the invention.

FIG. 1 illustrates an exemplary embodiment of an electrical connector 10, which includes a male component 12 and a female component 14. Electrical connector 10 may be configured, for example, to pass electrical signals carried by a cable 16 to a cable 18. Cables 16 and 18 may be any type of electrical elements for carrying electrical signals including, for example, single conductor cables, multi-conductor cables, ribbon cables, coaxial cables, data cables, or any other type of electrical signal-carrying apparatus.

Male component 12 may include one or more terminals 20. In one embodiment, terminals 20 include electrically conductive posts configured to engage corresponding receptacles 22 (FIG. 2) on female component 14. Terminals 20 may be constructed from any appropriate electrically conductive material. Further, while male component 12, as illustrated in FIG. 1, includes 10 terminals 20 (e.g., a 10-pin connector), male component 10 may include any number of terminals 20. The number of terminals 20 may match, for example, the number of conductors included in cable 16.

Male component 12 also includes at least two test pins 24 and 26. Test pins 24 and 26 may be configured to engage corresponding test receptacles 34 and 36 on female connector 14. At least one of test pins 24 and 26 may be shorter in length than at least one of terminals 20.

Figure 2:
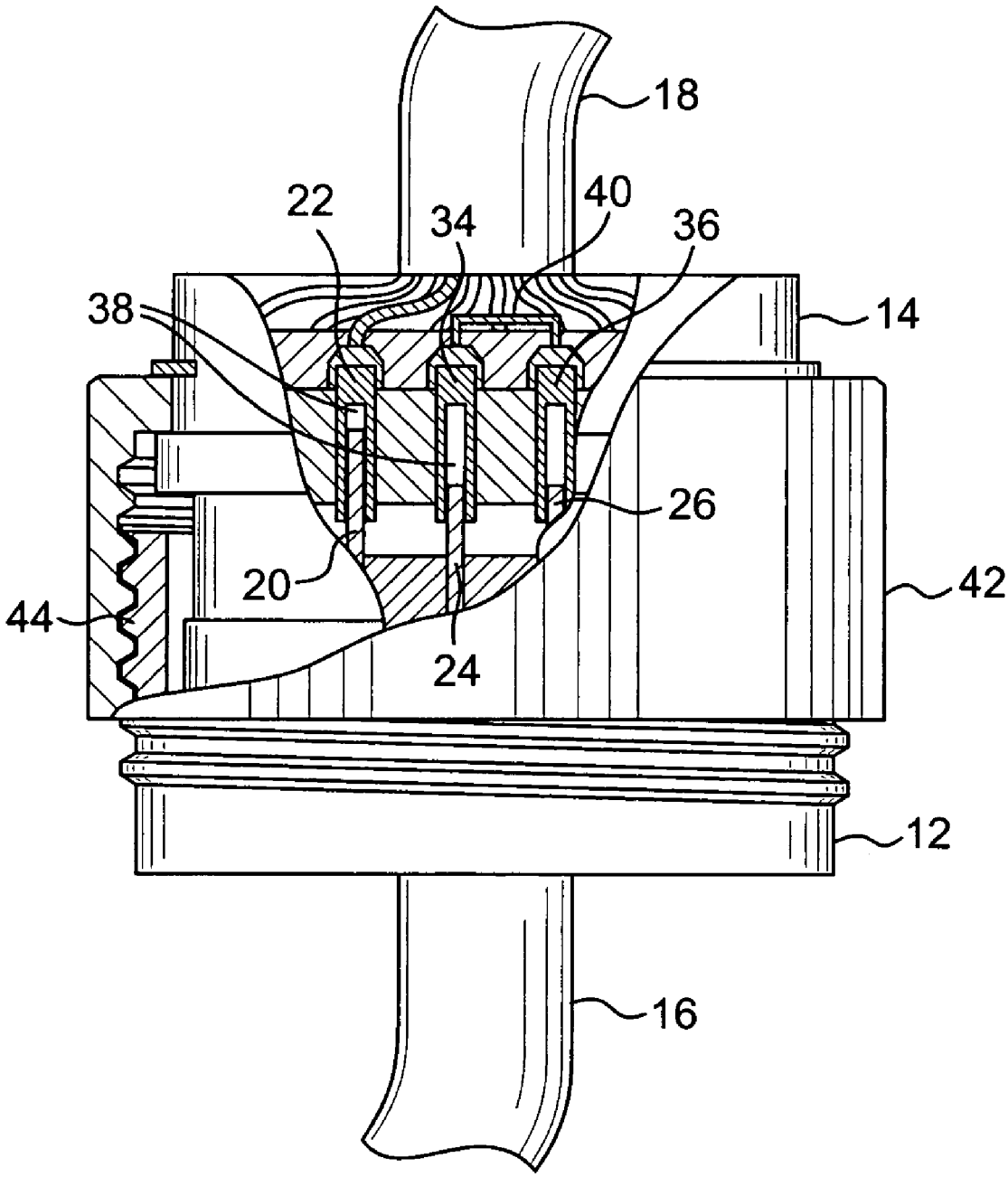
FIG. 2 is a diagrammatic, partial cutaway view of an electrical connector in accordance with an exemplary embodiment of the invention.

Female component 14 may include the same number of receptacles 22 as the number of terminals 20 provided on male component 12. Receptacles 22 may be any appropriate structure for establishing electrical contact with terminals 20. In one embodiment, as illustrated in FIG. 2, receptacles 22 each include an elongated, electrically conductive member having a cavity 38. Each cavity 38 may receive a terminal 20 when male component 12 engages female component 14. Each cavity 38 in receptacles 22 may be sized, or fitted with a contact element (not shown), such that terminals 20 contact the walls of cavities 38 to establish electrical contact between receptacles 22 and terminals 20.

Female component 14 also includes at least two test receptacles 34 and 36. Both test receptacles may be similar in configuration to receptacles 22. Thus, like receptacles 22, test receptacles 34 and 36 may include an electrically conductive member having a cavity 38 configured to receive, in the case of test receptacles 34 and 36, one of test pins 24 and 26.

In one exemplary embodiment, test receptacle 34 and test receptacle 36 may be maintained in electrical contact with one another. The electrical contact between test receptacle 34 and test receptacle 36 may be established by conductive element 40, which may be a wire, a solder ball, or any other appropriate conductor of electricity. It should be noted that a direct electrical connection between test receptacle 34 and 36 is not required in all applications. For example, in certain applications, one or more circuit elements (e.g., capacitors, resistors, inductive elements, switches, transistors, etc.) may be disposed in the conductive path between test receptacle 34 and test receptacle 36.

Because test receptacle 34 and test receptacle 36 may be in electrical contact with one another, test pin 24 may become electrically connected to test pin 26 when male component 12 is engaged with female component 14 by at least a threshold amount. For purposes of this disclosure, male component 12 is engaged with female component 14 when at least one of terminals 20 establishes electrical contact with any one of receptacles 22. The amount of engagement is a measure of how far the at least one terminal 20 travels after establishing electrical contact with any one of receptacles 22.

The threshold amount of engagement may be defined as an amount of travel of male component 12 after at least one of terminals 20 establishes electrical contact with at least one of receptacles 22 and up to a point where test pin 24 becomes electrically connected to test pin 26. The threshold amount of engagement may be measured or determined based on the relative sizes of test pins 24 and 26 and terminals 20. As noted above, at least one of test pins 24 and 26 may be shorter in length than at least one of terminals 20. The length of the shortest test pin, along with the lengths of terminals 20, determine the threshold amount of engagement.

In one embodiment, each of terminals 20 has a length L, and test pins 24 and 26 each have a length S, which is shorter than length L. In this configuration, the threshold amount of engagement, T, may be represented as:

$$T=L-S.$$

That is, in this configuration, the threshold amount of engagement is simply the difference between the length common to each of terminals 20 and the length of test pins 24 and 26.

In another embodiment, terminals 20 may be of different lengths. Test pins 24 and 26 may also be of different lengths. In this embodiment, the longest of terminals 20 may have a length L, and the shorter of test pins 24 and 26 may have a length S. As above, the threshold amount of engagement may be represented as:

$$T=L-S.$$

In this configuration, the threshold amount of engagement is equivalent to the difference between the longest terminal 20 and the shorter of test pins 24 and 26.

In still another embodiment, terminals 20 may be of different lengths. Test pins 24 and 26 may also be of different lengths. In this embodiment, the shortest of terminals 20 may have a length L, and the shorter of test pins 24 and 26 may have a length S. The threshold amount of engagement may be represented as:

$$T=L-S.$$

In this configuration, the threshold amount of engagement is equivalent to the difference between the shortest terminal 20 and the shorter of test pins 24 and 26.

The disclosed electrical connector 10 may be used to actively determine whether male component 12 and female component 14 are engaged. In one method, male component 12 is mated with female component 14, as illustrated in FIG. 2. In the fully engaged position illustrated in FIG. 2, terminals 20 engage receptacles 22. Similarly, test pin 24 and test pin 26 engage corresponding test receptacles 34 and 36. An electrical condition associated with test pins 24 and 26 may be measured. Based on the measured electrical condition, a determination can be made of whether male component 12 is engaged with female component 14 by at least a threshold amount.

The electrical condition may include one or more measurable electrical quantities. For example, the electrical condition may be a resistance value measured across test pin 24 and test pin 26. When male component 12 engages female component 14 beyond the threshold amount, as described above, an electrically conductive path may be established between test pin 24 and test pin 26, via conductive element 40, for example. Thus, at engagement amounts above the threshold value, the resistance between test pin 24 and test pin 26 may approach zero ohms. Conversely, at engagement amounts of less than the threshold value, the resistance between test pin 24 and test pin 26 would approach infinity (i.e., an open circuit condition).

Alternatively, various electrical signals may be used to test whether male component 12 is engaged with female component by at least a threshold amount. For example, an electrical signal, which may be a DC voltage potential, an AC voltage signal, a signal pulse, a digital signal, an analog signal, or any other electrical signal may be applied to one of test pins 24 and 26. Measuring a corresponding electrical signal at the other of test pins 24 and 26 may indicate that male component 12 is engaged with female component 14 beyond the threshold amount. No observed electrical signal at the other of test pins 24 and 26, however, may indicate that there is no engagement beyond the threshold amount.

Figure 3:
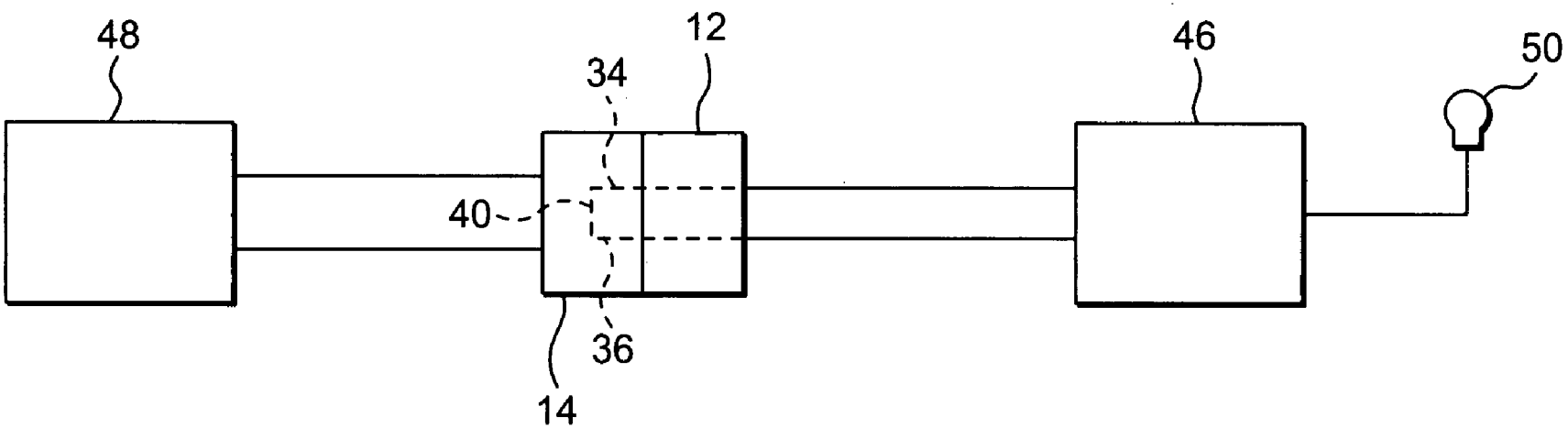
FIG. 3 is a schematic block-level diagram of a circuit including an electrical connector in accordance with an exemplary embodiment of the invention.

The electrical signal applied to one of test pins 24 and 26 may be supplied by any appropriate signal source known in the art. In one embodiment, however, as shown in FIG. 3, electrical connector 10 may be used in the electrical system of a vehicle (not shown). In this application, a controller 46, such as an electronic control unit (ECU) of the vehicle, may be used to supply and/or receive the electrical signals to and from test pins 24 and 26. Many other arrangements, however, are possible. For example, a constant source of a DC voltage potential (e.g., a battery) may be continuously connected to test pin 24, and controller 46 may monitor the presence of a corresponding DC voltage on test pin 26.

A variety of actions may be performed in response to a determination that male component 12 is not engaged with female component 14 by at least the threshold amount. For example, controller 46 may shut down one or more vehicle systems relating to electrical connector 10. Further, some form of indicator 50 may be activated to convey information relating to electrical connector 10. Indicator 50 may include one or more of a warning light, a warning message on a display, an audible alarm, or any other type of indicator that may be activated in response to a determination that male component 12 is not engaged with female component 14 by at least the threshold amount.

Electrical connector 10 may also include various other elements. For example, electrical connector 10 may include a locking element on male component 12 configured to engage with a corresponding locking element on female component 14. In one embodiment, the locking element on male component 12 includes a threaded ring 42, and the corresponding locking element on female component 14 includes a set of threads 44. Any other mechanism known in the art for securing male component 12 to female component 14 may be used in place of or in addition to threaded ring 42 and threads 44.

INDUSTRIAL APPLICABILITY

Electrical connector 10 may be configured to operate in any application where it would be desirable to know whether male component 12 and female component 14 are at least partially engaged (e.g., beyond the threshold amount). In one exemplary embodiment, electrical connector 10 may be used in an electrical system for a vehicle. For example, in certain applications, one or more electrical connectors 10 may be configured to carry electrical signals to an electrically driven vehicle component 48 that may include one or more of lights, HVAC units, electrical accessories, personal electronics, pumps, and any other electrical components in a vehicle. Electrical connector 10 may function as a high voltage connection element that provides high voltage signals to the electrically driven components. While electrical connector 10 may be used with both AC and DC voltage signals, in one embodiment, electrical connector 10 may be configured for use with high voltage DC potentials of greater than about 50 V.

Actively monitoring whether an appropriate electrical connection exists across electrical connector 10 has several potential benefits. For example, a proper electrical connection between male component 12 and female component 14 may be monitored even when visual inspection is not possible (e.g., when electrical connector 10 is hidden from view by other components). Further, an indication (e.g., warning light, etc.) that electrical connector 10 is partially or fully disengaged may prevent the inconvenience of searching through and testing various electrical components in an electrical system to troubleshoot an electrical malfunction caused by electrical connector 10. An indication that electrical connector 10 has become at least partially disengaged may minimize or prevent the possibility of hazardous electrical arcing, especially where electrical connector 10 passes high voltage levels. For example, a partially disengaged electrical connector 10 may be re-engaged before electrical connector 10 becomes fully disengaged, thereby avoiding a condition that could lead to arcing of voltage signals across male component 12 and female component 14.

Additionally, electrical connector 10 may be configured to warn of a partial disengagement for various different threshold engagement amounts. For example, adjusting the length of the shorter of test pins 24 and 26 may cause a corresponding change in the threshold engagement amount. Assuming a constant fully-engaged depth (i.e., the maximum depth to which terminals 20 engage receptacles 22), then changing the threshold engagement amount will also change the amount that male component 12 may be disengaged from female component 14 before issuing a warning indicator. To increase the amount that male component 12 may be disengaged from female component 14 before issuing a warning indicator, the length of the shorter of test pins 24 and 26 may be made longer. Conversely, to decrease the amount that male component 12 may be disengaged from female component 14 before issuing a warning indicator, the length of the shorter of test pins 24 and 26 may be made shorter.

It will be apparent to those skilled in the art that various modifications and variations can be made in the disclosed electrical connector without departing from the scope of the disclosure. Additionally, other embodiments of the electrical connector will be apparent to those skilled in the art from consideration of the specification. It is intended that the specification and examples be considered as exemplary only, with a true scope of the disclosure being indicated by the following claims and their equivalents.

What is claimed is:

1. An electrical connector, comprising:

a female component including a one or more receptacles, a first test receptacle, and a second test receptacle; and a male component having one or more terminals configured to engage the one or more receptacles, a first test pin configured to engage the first test receptacle, and a second test pin configured to engage the second test receptacle;

wherein the first test receptacle is electrically connected to the second test receptacle, such that the first test receptacle and the second test receptacle have a continuous connection therebetween; and wherein at least one of the first test pin and the second test pin is shorter in length than at least one of the one or more terminals and an electrical condition associated with the at least one of the first test pin and the second test pin provides an indication of the connection between the one or more receptacles and terminals.

2. The electrical connector of claim 1, wherein the first test pin is configured to receive an electrical signal from a controller unit of a vehicle.

3. The electrical connector of claim 1, wherein the first test pin is configured to receive an electrical signal from a DC voltage source.

4. The electrical connector of claim 1, wherein the second test pin is configured to provide an electrical signal to a controller unit of a vehicle.

5. The electrical connector of claim 1, further including a locking element on the male component configured to engage a corresponding locking element on the female component.

6. The electrical connector of claim 5, wherein the locking element on the male component includes a threaded ring and the corresponding locking element on the female component includes a set of threads.

7. The electrical connector of claim 1, wherein the electrical connector is configured to carry electrical signals to an electrically driven component in a vehicle.

8. The electrical connector of claim 7, wherein the electrical signals include DC voltages of greater than about 50 V.

9. The electrical connector of claim 1, wherein the first test pin is electrically connected to the second test pin when the male component is engaged with the female component by at least a threshold amount.

10. The electrical connector of claim 9, wherein the one or more terminals each have a length L, the first test pin and the second pin both have a length S, and wherein the threshold amount T is represented by:

$$T=L-S.$$

11. The electrical connector of claim 9, wherein a longest one of the one or more terminals has a length L, a shorter one of the first test pin and the second pin has a length S, and wherein the threshold amount T is represented by:

$$T=L-S.$$

12. The electrical connector of claim 9, wherein a shortest one of the one or more terminals has a length L, a shorter one of the first test pin and the second pin has a length S, and wherein the threshold amount T is represented by:

$$T=L-S.$$

13. A high voltage connector for a vehicle, comprising:

a female component including one or more receptacles, a first test receptacle, and a second test receptacle; and a male component having one or more terminals configured to engage the one or more receptacles, a first test pin configured to engage the first test receptacle, and a second test pin configured to engage the second test receptacle;

wherein the first test receptacle is electrically connected to the second test receptacle, such that the first test receptacle and the second test receptacle have a continuous connection therebetween;

wherein the first test pin and the second test pin are both shorter in length that the one or more terminals and an electrical condition associated with at least one of the first test pin and the second test pin provides an indication of the connection between the one or more receptacles and terminals, and wherein the first test pin is electrically connected to the second test pin when the male component is engaged with the female component by at least a threshold amount; and wherein the high voltage connector is configured to carry electrical signals to an electrically driven component in the vehicle.

14. The high voltage connector of claim 13, wherein the electrical signals include DC voltages of greater than about 50 V.

15. The high voltage connector of claim 13, wherein the one or more terminals each have a length L, the first test pin and the second pin both have a length S, and wherein the threshold amount T is represented by:

$$T=L-S.$$

16. The high voltage connector of claim 13, wherein the first test pin is configured to receive an electrical signal from a controller unit of a vehicle, and wherein the second test pin is configured to provide an electrical signal to a controller unit of a vehicle.

17. The high voltage connector of claim 13, wherein the first test pin is configured to receive an electrical signal from a DC voltage source.

18. An electrical connector, comprising:

a female component operatively coupled to a first cable and including one or more receptacles, a first test receptacle, and a second test receptacle; and a male component operatively coupled to a second cable and having one or more terminals configured to engage the one or more receptacles, a first test pin configured to engage the first test receptacle, and a second test pin configured to engage the second test receptacle;

wherein the first test receptacle is electrically connected to the second test receptacle;

wherein at least one of the first test pin and the second test pin is shorter in length than at least one of the one or more terminals; and wherein the electrical connector is configured to pass electrical signals between the first cable and the second cable when the female component is engaged with the male component by at least a threshold amount.

19. The electrical connector of claim 18, wherein an electrical signal may be applied to one of the first test pin and the second test pin to provide an indication of the connection between one or more receptacle and terminals.

20. The electrical connector of claim 18, wherein the first test pin is configured to receive an electrical signal from a controller unit.

21. The electrical connector of claim 18, wherein the first test pin is configured to receive an electrical signal from a DC voltage source.

22. The electrical connector of claim 18, wherein the second test pin is configured to provide an electrical signal to a controller unit.

23. The electrical connector of claim 18, wherein the electrical connector is configured to carry electrical signals to an electrically driven component in a vehicle.

24. The electrical connector of claim 23, wherein the electrical signals include DC voltages of greater than about 50 V.

25. The electrical connector of claim 18, wherein the first test pin is electrically connected to the second test pin when the male component is engaged with the female component by at least a threshold amount.

26. The electrical connector of claim 25, wherein the one or more terminals each have a length L, the first test pin and the second pin both have a length S, and wherein the threshold amount T is represented by:

$$T=L-S.$$

27. The electrical connector of claim 25, wherein a longest one of the one or more terminals has a length L, a shorter one of the first test pin and the second pin has a length S, and wherein the threshold amount T is represented by:

$$T=L-S.$$

28. The electrical connector of claim 25, wherein a shortest one of the one or more terminals has a length L, a shorter one of the first test pin and the second pin has a length S, and wherein the threshold amount T is represented by:

$$T=L-S.$$

* * * * *